US009360017B2

(12) United States Patent
Hansen

(10) Patent No.: US 9,360,017 B2
(45) Date of Patent: Jun. 7, 2016

(54) PUMP ASSEMBLY HAVING AN INTEGRATED USER INTERFACE

(75) Inventor: Kim Hoerdum Hansen, Olathe, KS (US)

(73) Assignee: GRUNDFOS PUMPS CORPORATION, Olathe, KS (US)

( * ) Notice: Subject to any disclaimer, the term of this patent is extended or adjusted under 35 U.S.C. 154(b) by 858 days.

(21) Appl. No.: 12/358,837

(22) Filed: Jan. 23, 2009

(65) Prior Publication Data

US 2010/0189572 A1 Jul. 29, 2010

(51) Int. Cl.
*F04D 15/00* (2006.01)
*F04D 15/02* (2006.01)

(52) U.S. Cl.
CPC ..... *F04D 15/0066* (2013.01); *F04D 15/0027* (2013.01); *F04D 15/0227* (2013.01)

(58) Field of Classification Search
CPC ..... F04D 13/06; F04D 29/605; F04D 15/00; Y10T 29/49236
USPC ..... 417/43, 44.11, 44.1, 63
See application file for complete search history.

(56) References Cited

U.S. PATENT DOCUMENTS 3,399,624 A * 9/1968 Echard et al. ..... 417/326
4,363,609 A * 12/1982 Cosentino ..... F04B 43/1276 417/477.5
4,670,007 A * 6/1987 Wheeldon ..... A61M 5/16895 128/DIG. 13
4,715,786 A * 12/1987 Wolff ..... G05D 7/0676 417/22
4,745,759 A * 5/1988 Bauer ..... A01N 1/02 435/284.1
4,747,826 A * 5/1988 Sassano ..... A61M 5/44 128/DIG. 12
4,770,168 A * 9/1988 Rusz ..... A61M 16/18 128/203.12
4,848,164 A * 7/1989 Quarve et al. ..... 73/861.77
4,902,277 A * 2/1990 Mathies ..... A61B 1/12 604/118
4,910,682 A * 3/1990 Wolff ..... G05D 7/0676 417/22
4,945,491 A 7/1990 Rishel
5,000,733 A * 3/1991 Mathies ..... A61B 1/12 604/118
5,181,910 A * 1/1993 Scanlon ..... 604/67
5,310,113 A * 5/1994 Cowgur ..... A01M 7/0092 239/10
5,318,413 A * 6/1994 Bertoncini ..... 417/475
5,764,148 A 6/1998 Frasier (Continued)

FOREIGN PATENT DOCUMENTS

JP 58045514 A2 3/1983
JP 02136584 A2 5/1990
JP 05223318 A2 8/1993

*Primary Examiner* — Andrew Coughlin
*Assistant Examiner* — Fatima Farokhrooz
(74) *Attorney, Agent, or Firm* — Jay J. Hoette; The Small Patent Law Group, LLC

(57) ABSTRACT

A pump assembly includes a permanent magnet motor having a stator with coil windings, a rotor assembly having a shaft and an impeller attached to the shaft, with the shaft being driven by the stator and the impeller driving fluid through the pump assembly, and a control module having a controller and a user interface. The controller measures characteristics of the stator, the controller determines at least one of the flow rate and the pressure of the fluid moved through the pump assembly based on the characteristics measured, and the user interface is configured to display an output representative of the flow rate. A method of operating a pump includes the steps of measuring at least one operating characteristic of the pump utilizing the controller integrated with the pump, determining a flow characteristic of the pump based on the at least one measured operating characteristic, and displaying the determined flow characteristic on a user interface integrated with the pump.

29 Claims, 7 Drawing Sheets

(56) References Cited

U.S. PATENT DOCUMENTS 5,941,690 A * 8/1999 Lin ..... F04B 49/065 417/44.2
5,985,346 A * 11/1999 Ayash ..... A21C 3/10 134/22.11
6,077,246 A * 6/2000 Kullas ..... A61M 1/0058 417/477.2
6,137,416 A 10/2000 Meador
6,394,206 B1 * 5/2002 Fury ..... 180/53.4
6,424,105 B1 7/2002 Breit et al.
6,436,072 B1 * 8/2002 Kullas et al. ..... 604/151
6,464,464 B2 10/2002 Sabini et al.
6,651,900 B1 11/2003 Yoshida
6,942,473 B2 * 9/2005 Abrahamson et al. ..... 417/474
7,437,215 B2 * 10/2008 Anderson et al. ..... 700/282
8,404,117 B1 * 3/2013 Steinbrueck et al. ..... 210/252
8,714,934 B2 * 5/2014 Laing et al. ..... 417/20
2002/0009363 A1 * 1/2002 Ozaki et al. ..... 415/203
2002/0071775 A1 * 6/2002 Laing ..... 417/410.1
2002/0098255 A1 * 7/2002 Ayash ..... 425/208
2004/0062658 A1 * 4/2004 Beck et al. ..... 417/42
2004/0143151 A1 * 7/2004 Mori et al. ..... 600/16
2005/0014991 A1 * 1/2005 Sugiura ..... 600/17
2005/0077389 A1 * 4/2005 Lebeda et al. ..... 239/302
2005/0095155 A1 * 5/2005 Blight et al. ..... 417/477.13
2006/0045750 A1 3/2006 Stiles
2007/0075157 A1 * 4/2007 Lebeda ..... A01D 43/14 239/8
2007/0088269 A1 * 4/2007 Valego et al. ..... 604/151
2007/0114162 A1 5/2007 Stiles et al.
2007/0154323 A1 7/2007 Stiles, Jr. et al.
2008/0119822 A1 * 5/2008 Knauper ..... 604/516
2008/0156476 A1 * 7/2008 Smisson et al. ..... 165/185
2009/0107470 A1 * 4/2009 Scharfenberg ..... 123/497
2010/0185280 A1 * 7/2010 Ayre et al. ..... 623/3.13
2010/0226803 A1 * 9/2010 Tajima et al. ..... 417/423.7

* cited by examiner

PUMP ASSEMBLY HAVING AN INTEGRATED USER INTERFACE

BACKGROUND OF THE INVENTION

The subject matter herein relates generally to pump assemblies, and more particularly to pump assemblies having integrated user interfaces.

Modern pumps, in particular in the form of heating circulation pumps, often include electrical drive motors which are designed as permanent magnet motors. The permanent magnet motors include a rotor which is equipped with permanent magnets and which is set into rotation by way of subjecting corresponding stator coils to current. Known rotors typically have a central rotor shaft which is rotatably mounted on bearings, such as sliding bearings, mounted in a stator housing or on the stator. The permanent magnets are fixed on the rotor shaft, which drive the rotor shaft. An impeller is typically mounted to an end of the rotor shaft and is driven by the rotor shaft to move fluid through the pump.

Permanent magnet motor pumps typically have a high-efficiency as compared to other types of pumps. As such, permanent magnet motor pumps have lower power consumption for moving fluid as compared other centrifugal pumps. Permanent magnet motor pumps operate quietly, and thus are desirable for certain applications, such as use in homes.

One particular application that typically uses permanent magnet motor pumps, is a hydronic heating or cooling system, wherein the pump supplies fluid to different zones or circuits. A problem with such systems is that it may be difficult to determine an efficiency or other operating characteristics of the pump because the system is a closed system. It is difficult to determine how often or at what capacity the pump is operating at any given time. One solution to such problems is to provide sensors within the system to monitor operating characteristics of the pump or the system overall. Examples of separate sensors that may be provided within the system include flow sensors, pressure sensors, power consumption monitors, and the like. However, adding such sensors increases the overall cost and complexity of the system. Additionally, the sensors typically operate independently of the pump and may be located remotely with respect to the pump.

A need remains for a pump that may be operated in a cost effective and reliable manner. A need remains for a permanent magnet motor type pump that can measure operating characteristics of the pump.

BRIEF DESCRIPTION OF THE INVENTION

In one embodiment, a pump assembly is provided that includes a permanent magnet motor having a stator with coil windings, a rotor assembly having a shaft and an impeller attached to the shaft, with the shaft being driven by the stator and the impeller driving fluid through the pump assembly, and a control module having a controller and a user interface integrated with the controller. The controller measures characteristics of the stator, the controller determines at least one of the flow rate and the pressure of the fluid moved through the pump assembly based on the characteristics measured, and the user interface is configured to display an output representative of the flow rate.

Optionally, the controller may be coupled to the stator for supplying power to the coil windings. The controller may measure a current supplied to the coil windings and the controller may measure a frequency of a voltage of the coil windings. The controller may determine a flow rate of the pump assembly based on the current measured and the frequency measured. The controller may determine a flow rate of the pump based on a power balance equation. The controller may measure characteristics relating to a power consumed by the stator and a speed of the rotor to determine the flow rate. The control module may determine the flow rate without the use of a flow sensor.

In another embodiment, a control module for a permanent magnet motor pump is provided that includes a controller configured to be coupled to a stator of the permanent magnet motor. The controller is configured to be coupled to a power source, and the controller supplies power to coil windings of the stator. The controller measures characteristics of the stator, wherein the controller determines a flow characteristic of the permanent magnet motor pump based or the measured characteristics of the stator. The control module also includes a user interface integrated with the controller, where the user interface displays an output representative of the flow characteristic.

In a further embodiment, a method of operating a pump is provided that includes the steps of measuring at least one operating characteristic of the pump utilizing the controller integrated with the pump, determining a flow characteristic of the pump based on the at least one measured operating characteristic, and displaying the determined flow characteristic on a user interface integrated with the pump.

DETAILED DESCRIPTION OF THE INVENTION

Figure 1:
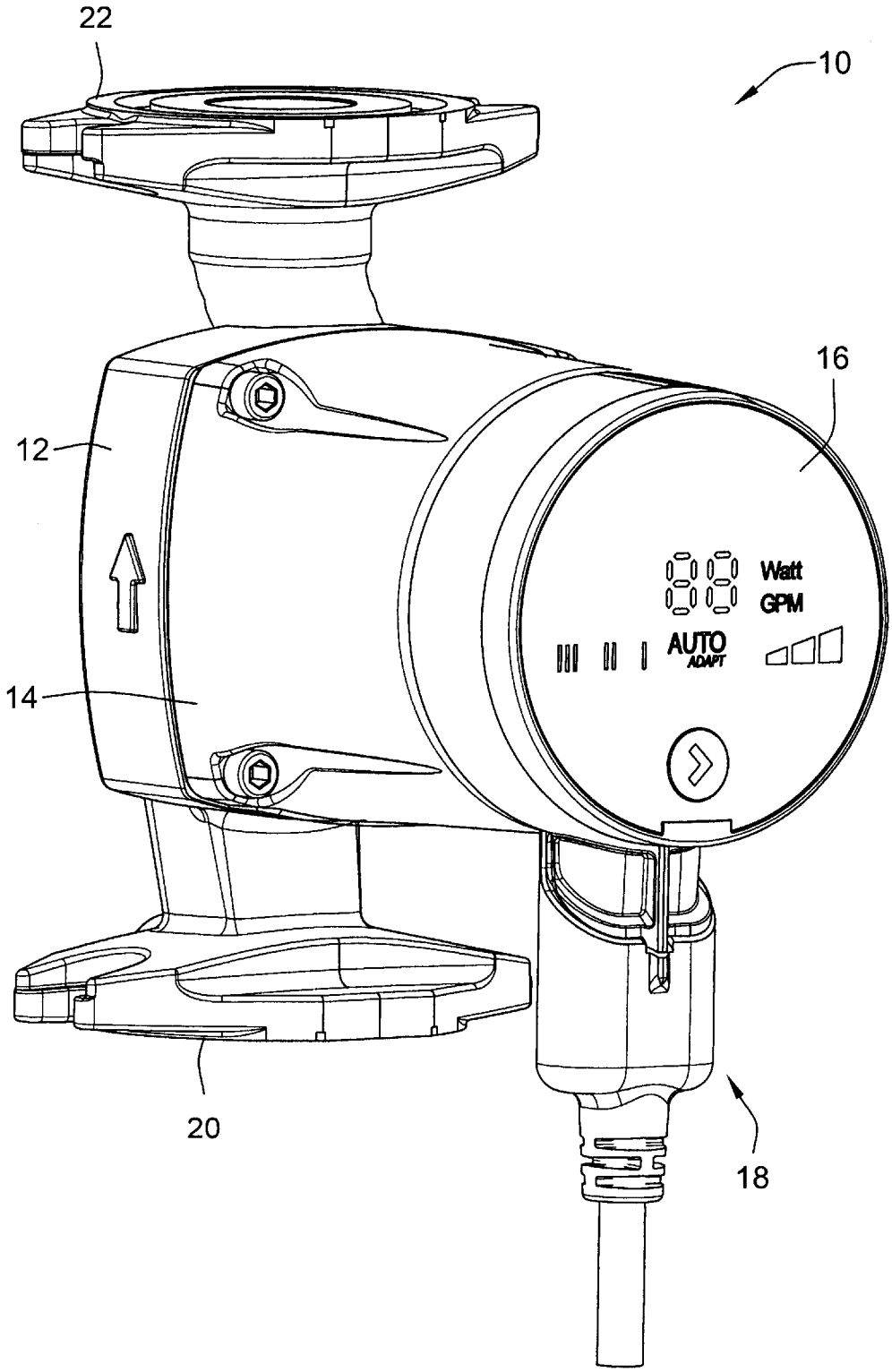
FIG. 1 illustrates a pump assembly in accordance with an exemplary embodiment.

FIG. 1 illustrates a pump assembly 10 in accordance with an exemplary embodiment. The pump assembly 10 includes a pump housing 12, a motor 14 attached to the pump housing 12, and a control module 16 attached to the motor 14. The control module 16 operates the motor 14 to move fluid through the pump housing 12. The motor 14 is an electrical motor that is driven by a power source connected to the control module 16 by a power connection 18. In an exemplary embodiment, the motor 14 is a permanent magnet motor.

The pump housing 12 includes a suction end 20 and a discharge end 22. The suction end 20 may be coupled to a supply pipe (not shown) and the discharge end 22 may be coupled to a discharge pipe (not shown). Fluid is supplied to the pump housing 12 by the supply pipe and the fluid is moved to the discharge pipe by the pump assembly 10. Different flow characteristics, such as the amount of flow, the flow rate, the pressure of the fluid, the temperature of the fluid, the amount of heat energy used by the system and the like may be controlled by the control module 16 operating the motor 14 according to various operating parameters.

Figure 2:
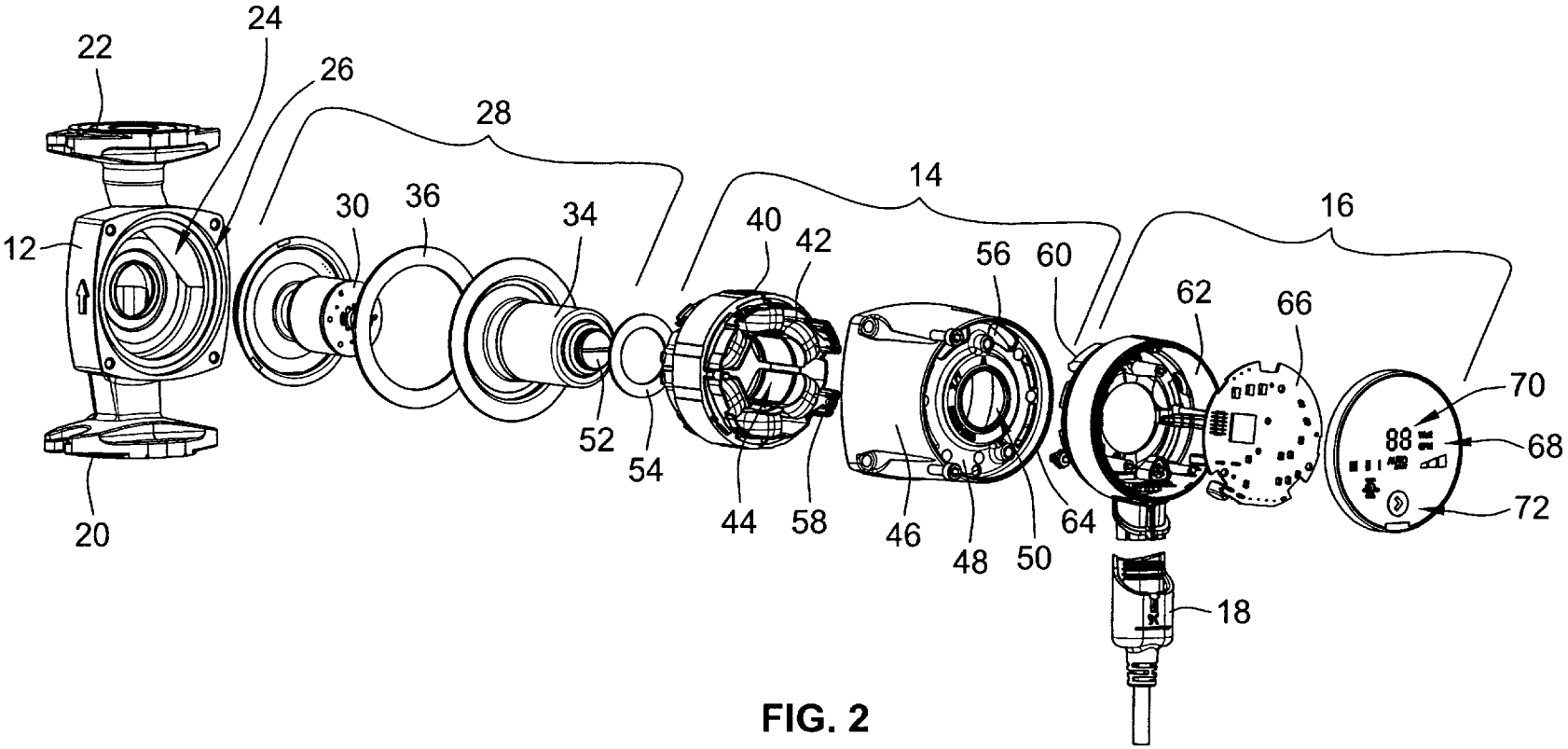
FIG. 2 is a front exploded view of the pump assembly shown in FIG. 1.
Figure 3:
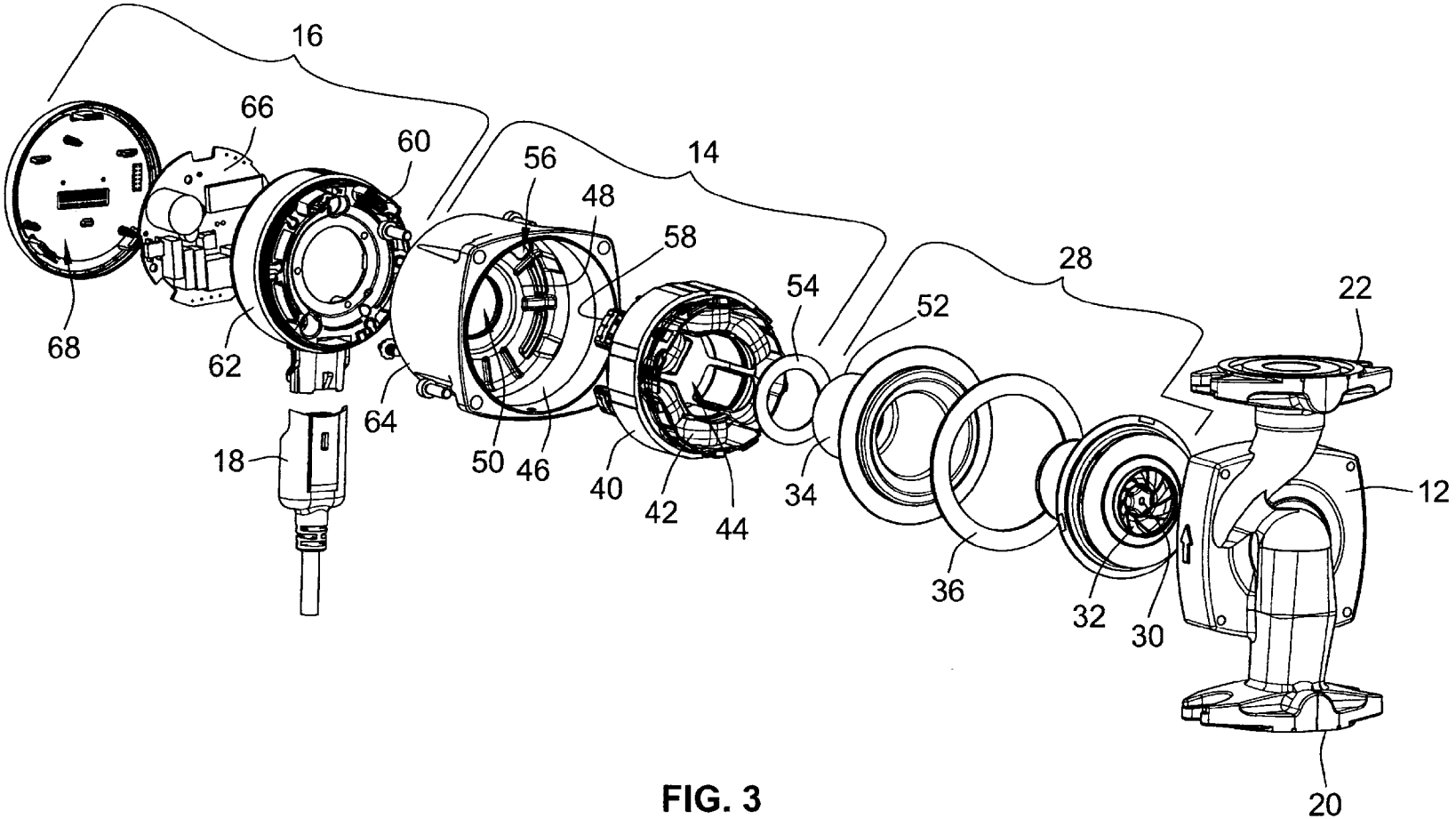
FIG. 3 is a rear exploded view of the pump assembly shown in FIG. 1.

FIGS. 2 and 3 are front and rear exploded views of the pump assembly 10 illustrating the pump housing 12, the motor 14 and the control module 16. The pump housing 12 includes a chamber 24 extending between the suction and discharge ends 20, 22. The chamber 24 channels the fluid between the ends 20, 22. The pump housing 12 has an opening 26 that receives a rotor assembly 28 therein. The opening 26 opens to the chamber 24.

The rotor assembly 28 includes a rotor shaft 30 and at least one impeller 32 mounted to the rotor shaft 30. The impeller 32 is in fluid communication with the fluid in the pump housing 12. The rotor shaft 30 is rotated to move the impeller 32 and thus move the fluid through the pump housing 12. The rotor assembly 28 includes a rotor can 34. The rotor shaft 30 is at least partially received in the rotor can 34. Optionally, one or more gaskets 36 may be provided between the rotor assembly 28 and the pump housing 12 to provide a fluid seal.

In an exemplary embodiment, the motor 14 is a permanent magnet motor, and includes a stator 40 having a plurality of coil windings 42. The stator 40 has a central bore 44 that receives a portion of the rotor assembly 28. The coil windings 42 are positioned around a central bore 44. Power or current is supplied to the coil windings 42 to create a stator field. The stator field acts on the rotor assembly 28 to drive the rotor shaft 30. The power supplied to the coil windings 42 may be controlled to control the rotational speed of the rotor shaft 30, and thus the impeller 32.

The motor 14 includes a stator housing 46 that may be coupled to the pump housing 12. The stator 40 is received in the stator housing 46. A portion of the rotor assembly 28 may also be positioned in the stator housing 46. The stator housing 46 includes a wall 48 having a central opening 50. A front end 52 of the rotor can 34 is held within the central opening 50. A gasket 54 may be held between the front end 52 and the wall 48.

In an exemplary embodiment, the wall 48 includes power connector apertures 56 that receives power connectors 58 of the stator 40 and/or power connectors 60 of the control module 16. The power connectors 60 of the control module 16 are electrically connected to the power connection 18 and power is transmitted to the power connectors 58 via the power connectors 60. In the illustrated embodiment, the power connection 18 is represented by a power cable with a corresponding cable connector at the end of the power cable. The power connectors 58 of the stator 40 are mated with the power connectors 60 of the control module 16 to create a power supply path from the control module 16 to the stator 40. The power connectors 58 are connected to corresponding coil windings 42, wherein power supplied to the power connectors 58 is transmitted to the coil windings 42.

The control module 16 includes a control box 62 that is mounted to a front end 64 of the stator housing 46. The control module 16 also includes a controller 66 received within the control box 62 and a user interface 68 integrated with the control box 62 and controller 66. The controller 66 and/or the user interface 68 may be electrically connected to the power connection 18. In the illustrated embodiment, the user interface 68 is integrated with the control box 62 and controller 66 by being directly mounted onto the control box 62 and electrically connected to the controller 66. In alternative embodiments, the user interface 68 may be integrated with the control box 62 and controller 66 without being mounted directly to the control box 62. For example, the user interface 68 may be positioned adjacent the pump assembly 10 or remote from the pump assembly 10 and still be integrated with the pump assembly 10. The user interface 68 may be mounted to another portion of the pump assembly 10, such as by being mounted to the stator housing 46 or another part of the pump assembly 10. The user interface 68 may be indirectly connected to the control box 62, such as by a mounting arm or other linking component that supports the user interface 68. The user interface 68 may be integrated with the pump assembly 10 by being physically positioned remote from the other components of the pump housing 10 but being connected to the pump assembly 10, such as the controller 66, by a communication link. Data may be transmitted between the user interface 68 and the controller 66 by the communications link. For example, an electrical cord may be connected between the user interface 68 and the controller 66 for sending data and/or power therebetween. The user interface 68 may be connected with the controller 66 by a wireless connection, wherein data is transmitted wirelessly therebetween. In the various embodiments, the user interface 68 may be conveniently positioned for access and viewing by the user.

In an exemplary embodiment, the user interface 68 is electrically connected to the controller 66. The user interface 68 includes a display 70 that outputs or relays information to a user and an input 72 that may be activated by a user to interact with the controller 66 and/or the pump assembly 10. The input 72 may include one or more buttons, keypads, keyboards, pointers, dials and the like that may be manipulated by the user, such as to change an operation of the controller 66 and/or the pump assembly 10. The input 72 may include one or more connectors that may be mated with a corresponding connector of another device or component, such as an external device or component that is not integrated with the pump assembly 10, but rather operates independently of the pump and is not connected to the pump assembly 10. The display 70 may have one or more readout, screen or other display component for conveying information to the user. The display 70 may be digital or analog. The user interface 68 may also include an output other than a visual output, such as an audio output, a wireless transmission output, and the like.

In an exemplary embodiment, the controller 66 controls the supply of power from the power connection 18 to the coil windings 42 via the power connectors 58, 60. For example, the controller 66 may control the amount of current supplied to the coil windings 42 and/or the timing of the power supply to the coil windings 42. Optionally, the power may be continuously supplied. Alternatively, the power may be pulsed at predetermined intervals, such as pulse modulated signal. When current is supplied to the coil windings 42, magnetic fields are created that induce rotation of the rotor shaft 30. The amount of power supplied may be variable and adjustable to change the rotor speed. A power circuit may be defined by any of the controller 66, the power connection 18, the power connectors 58, 60 and the coil windings 42. Electrical characteristics of the power circuit or any components thereof, such as the voltage frequency, the current and the like, may be measured by the controller 66 and used by the controller to determine operating characteristics of the pump assembly 10 and/or flow characteristics of the fluid moved by the pump assembly 10. Optionally, the electrical characteristics may be continuously monitored, or may be monitored at selected times, such as between pulsed signals.

The controller 66 monitors and/or measures electrical characteristics of the stator 40 which correspond to operating characteristics of the pump assembly 10. The operating characteristics of the pump assembly 10 may correspond to flow characteristics of the fluid moved through the pump assembly 10, such as water work, flow rate, pressure of the fluid, temperature of the fluid, the amount of heat energy used by the system (e.g. expressed in BTU) and the like. The controller 66 determines or calculates the flow characteristics of the fluid moved through the pump assembly 10 based on the measured operating characteristics. The controller 66 measures the power consumed by the pump assembly 10. For example, the controller 66 may measure the current supplied to the stator 40 and/or the current supplied to the power circuit. The controller 66 measures a frequency of the voltage of the power supply circuit and/or the stator 40. The controller 66 may determine a rotational speed of the rotor shaft 30 based on the frequency of the voltage. Optionally, the controller 66 may determine the rotations speed using a method similar to the method described in U.S. Pat. No. 7,043,395, the subject matter of which is incorporated by reference in its entirety. In an exemplary embodiment, the controller 66 determines a flow rate of the fluid moved through the pump assembly 10 based on the power consumed by the pump assembly 10, the measured current supplied to the power circuit and/or the stator 40 and the measured rotational speed of the rotor shaft 30. The controller 66 may determine the amount of heat energy used by the system based on the determined or measured flow rate and based on temperature measurements relating to the amount of heat lost or gained. The amount of heat energy may be expressed in BTU's. Optionally, the controller 66 may receive signals from one or more sensor that provides signals relating to flow characteristics, such as flow, pressure, temperature, shaft speed, power consumption and the like.

In operation, the arrangement of the rotor and stator 40 of the permanent magnet motor, as compared to other types of drive arrangements for pumps, provides very little slip of the rotor shaft 30. Due to the limited amount of slippage of the rotor shaft 30, the rotational speed of the rotor shaft 30 can be approximated very accurately across a wide range of speeds. As such, the use of the permanent magnet motor provides accurate measurements of rotor shaft rotational speeds, which are used by the controller 66 to determine the flow characteristics in an accurate manner.

The controller 66 sends one or more signals relating to the operating characteristics of the pump assembly 10 and/or the flow characteristics of the fluid moved through the pump assembly 10 to the display 70. For example, the controller 66 may send a signal relating to the flow rate or pressure of the fluid to the display 70, and the display 70 may display an output representative of the flow rate or pressure of the fluid moved through the pump assembly 10. The display 70 may additionally or alternatively display outputs representative of other operating characteristics and/or flow characteristics, such as power usage, operating status, operating mode, total flow, pressure, temperature and the like.

Figure 4:
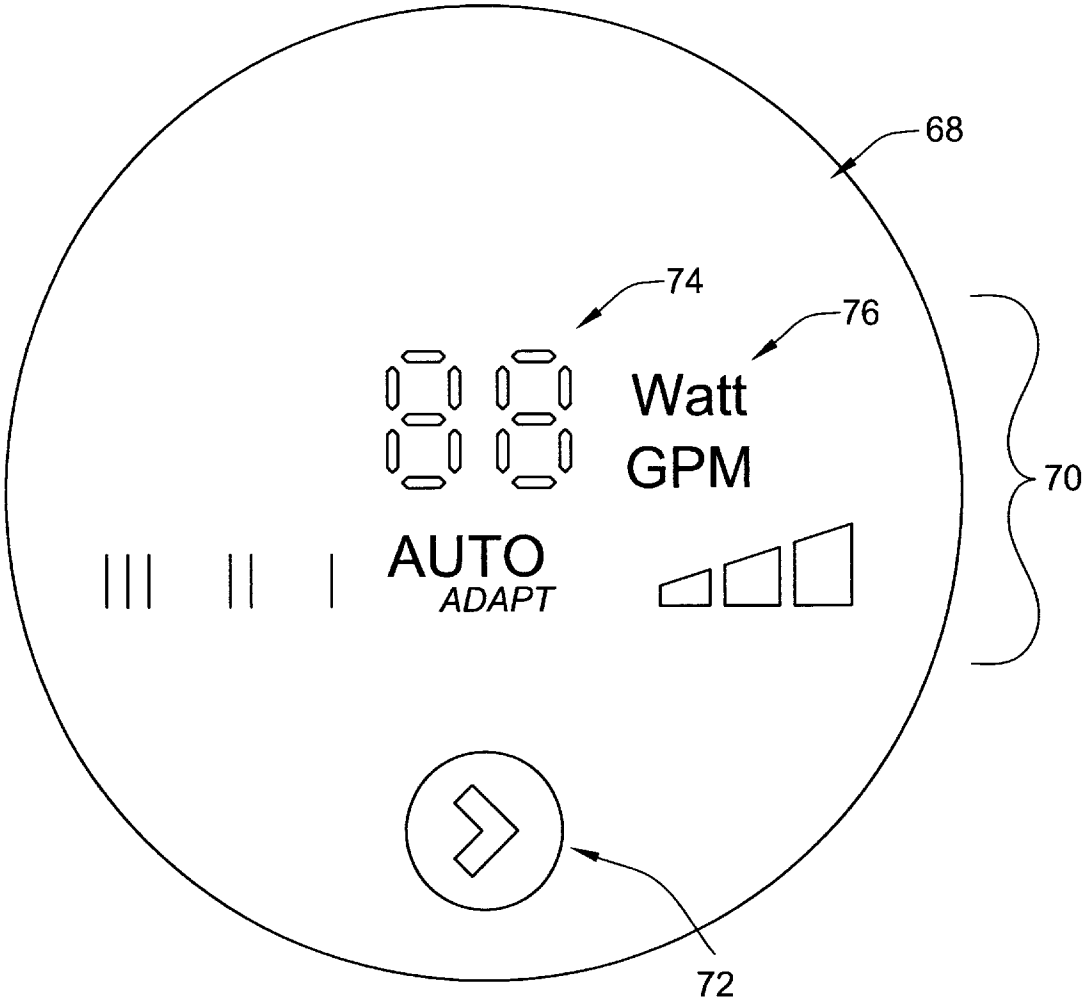
FIG. 4 illustrates a user interface integrated with the pump assembly shown in FIG. 1.

FIG. 4 illustrates the user interface 68 that is integrated with the pump assembly 10 (shown in FIG. 1). In the illustrated embodiment, the input 72 is represented by a push button that selects different functions or operation modes for the pump assembly 10. For example, in an exemplary embodiment, the pump assembly 10 may operate in three different modes of operation. The pump assembly 10 may operate in a fixed speed mode, the pump assembly 10 may operate in a constant pressure mode, and the pump assembly 10 may operate in an AUTOAdapt mode wherein the pump assembly 10 automatically adapts to the system load on the pump assembly 10. The pump assembly 10 may operate in other modes in alternative embodiments such as a constant flow mode where the flow rate is held at a constant level. Optionally, in the fixed speed mode, the pump assembly 10 may have multiple speeds. In the illustrated embodiment, the pump assembly 10 has three fixed speeds identified as I, II, III. Optionally, in the constant pressure mode, the pump assembly 10 may operate at different levels of constant pressure. In the illustrated embodiment, the pump assembly 10 has three levels of constant pressure identified by the three sloped bars of different height. In the AUTOAdapt mode, the pump assembly 10 may have a variable speed and/or variable pressure depending on the load on the pump assembly 10.

In the illustrated embodiment, the display 70 is represented by a readout. The display 70 has a numerical readout section 74 that displays one or more digits representative of an output. The display 70 has an indicator section 76 that includes one or more indicators that relate to the numerical readout section 74. For example, in illustrated embodiment, the indicator section 76 has a Watt indicator and a GPM indicator representative of a power consumption and a flow rate, respectively. The power consumption and the flow rate may be represented by different indicators in alternative embodiments. For example, rather than displaying a numerical output, the output, may be graphical or an analog display. Additionally, other types of indicators may be provided in other alternative embodiments, such as a pressure indicator. The particular characteristic represented in the numerical readout section 74 may be lit up or otherwise identified in the indicator section 76. For example, the numerical readout section 74 may cycle between a number indicative of power consumption and a number indicative of flow rate, where the particular Watt or GPM indicator is lit up corresponding to the particular number shown in the numerical readout section 74.

Figure 5:
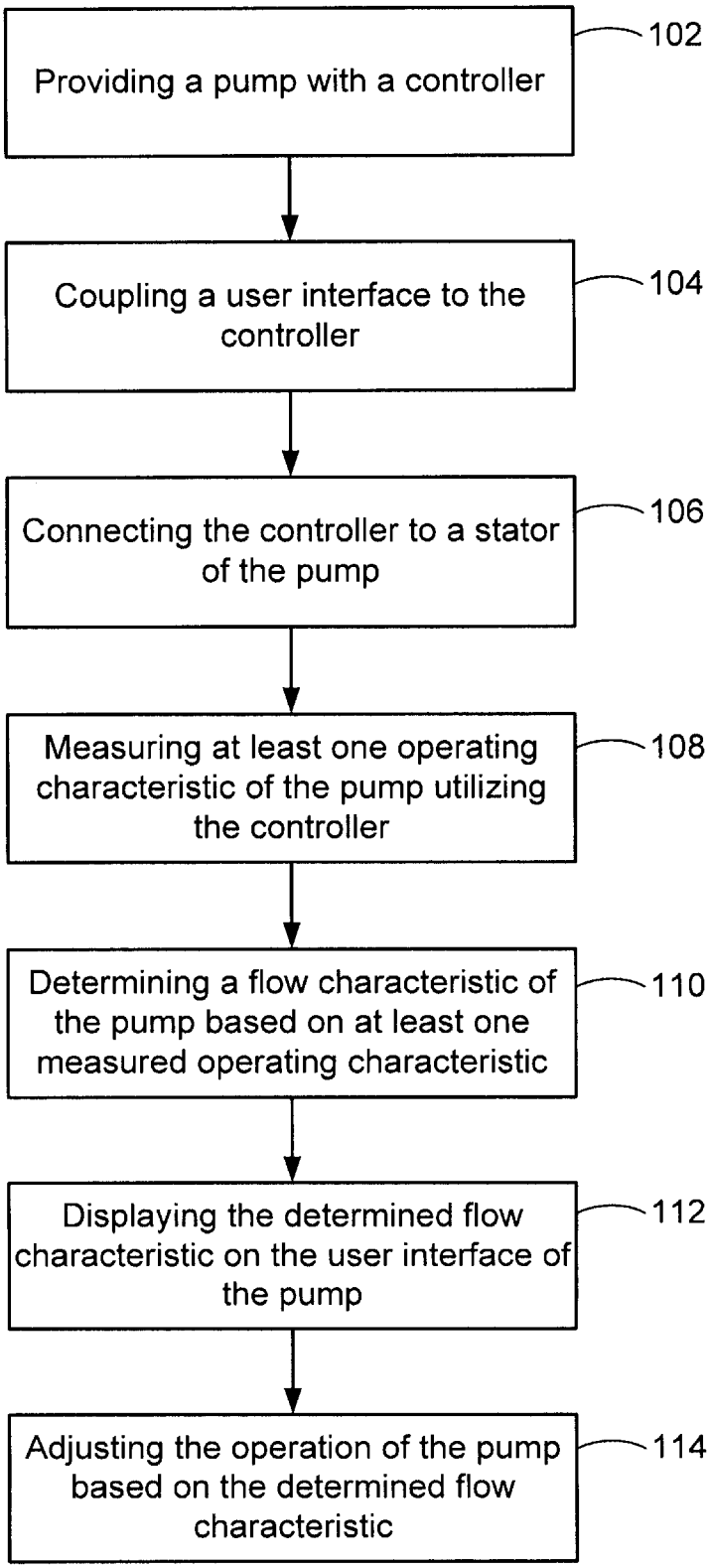
FIG. 5 is a flow chart showing an exemplary method of operating the pump assembly shown in FIG. 1.

FIG. 5 is a flow chart showing an exemplary method of operating the pump assembly 10 (shown in FIG. 1). The method may include any combination of the following steps depending on the particular application. The method is described in terms of a pump similar to the pump assembly 10 described above being a permanent magnet motor pump having a controller with a user interface that displays on a user interface, information relating to the operation of the pump and/or information relating to flow characteristics of the fluid moved by the pump.

The method includes providing 100 a pump with a controller within a housing of the pump. The method includes mechanically and electrically coupling 102 the user interface to the controller. The method includes coupling 104 a power source to the pump. The method includes connecting 106 the controller to the stator and/or the coil windings of the stator such that power supplied to the stator may be controlled by the controller.

The method includes measuring 108 at least one operating characteristic of the pump utilizing the controller integrated with the pump. The measuring 108 may include measuring a current supplied to the pump. The measuring 108 may include measuring a speed of a rotor of the pump. The measuring 108 may include measuring at least one operating characteristic of the stator of the permanent magnet motor pump. The measuring 108 may include measuring a voltage frequency of the coil windings. The measuring 108 may include measuring a power supply provided to the pump, such as a rectified supply voltage, a DC voltage, or another power supply value. The measuring 108 may include measuring other characteristics of the pump, where the measured characteristics relate to or may be used by the controller to calculate or determine other operating characteristics of the pump and/or to calculate or determine flow characteristics of the fluid moved by the pump.

The method includes determining 110 a flow characteristic of the pump based on the at least one measured operating characteristic. For example, the water work, flow fate, pressure or other flow characteristic may be determined. In an exemplary embodiment, the step of determining 110 the flow characteristic of the pump is performed without the use of a separate sensor, such as a flow sensor or pressure sensor measuring the flow rate or pressure of the throughput of the pump. Rather, the controller includes hardware and/or software components that calculate or otherwise determine the flow characteristic of the fluid moved through the pump based on operating characteristics of the pump, such as operating characteristics of the stator. No additional connection to a separate flow sensor is needed to determine the flow rate. Additionally, the flow characteristic may be determined without actually measuring or otherwise interacting with the fluid being moved through the pump. Optionally, the controller may include one or more look-up table to determine the flow characteristic based on the measured operating characteristic. Optionally, the controller may include a microprocessor or other component having software or other programs that determine the flow characteristic of the fluid moved through the pump using the measured operating characteristics. The controller may use an algorithm or other formula to determine the flow characteristic based on characteristics of the stator. In an exemplary embodiment, the controller determines the flow characteristic of the pump based on a measured power supply to the pump and a speed of the rotor. The speed of the rotor may be determined based on an operating characteristic of the stator, such as a frequency of the voltage of the power supply or the frequency of the voltage of the stator or the frequency of the stator field. As such, the controller only needs to be connected to or otherwise receive signals from the stator to determine the flow characteristic, as opposed for monitoring or measuring the rotor or the fluid.

The method also includes displaying 112 the determined flow characteristic on the user interface integrated with the pump. The flow characteristic may be displayed in any fashion and on any type of display integrated with the pump. For example, the flow characteristic may be displayed on the display 70 (shown in FIG. 4). Other types of display are possible in alternative embodiments. The user interface may be directly connected to the controller to receive signals from the controller relating to the flow characteristic for display.

The method includes adjusting 114 the operation of the pump based on the determined flow characteristic or other measured operating characteristic. For example, the controller may change the mode of operation based on the determined flow characteristic or other measured operating characteristic. The controller may change the power supplied to the stator. The controller may change the rotor speed. The controller may change other pump operations. As described above, the pump may be operated at a number, of different speeds, the pump may be operated at different constant pressures, the pump may be operated in the AUTOAdapt mode, or the pump may be operated in other operation modes (e.g. constant flow mode or constant pressure mode). The controller may adjust between different speeds or different constant pressures or one of the other modes of operation based on the determined flow characteristic or other measured operating characteristic.

Figure 6:
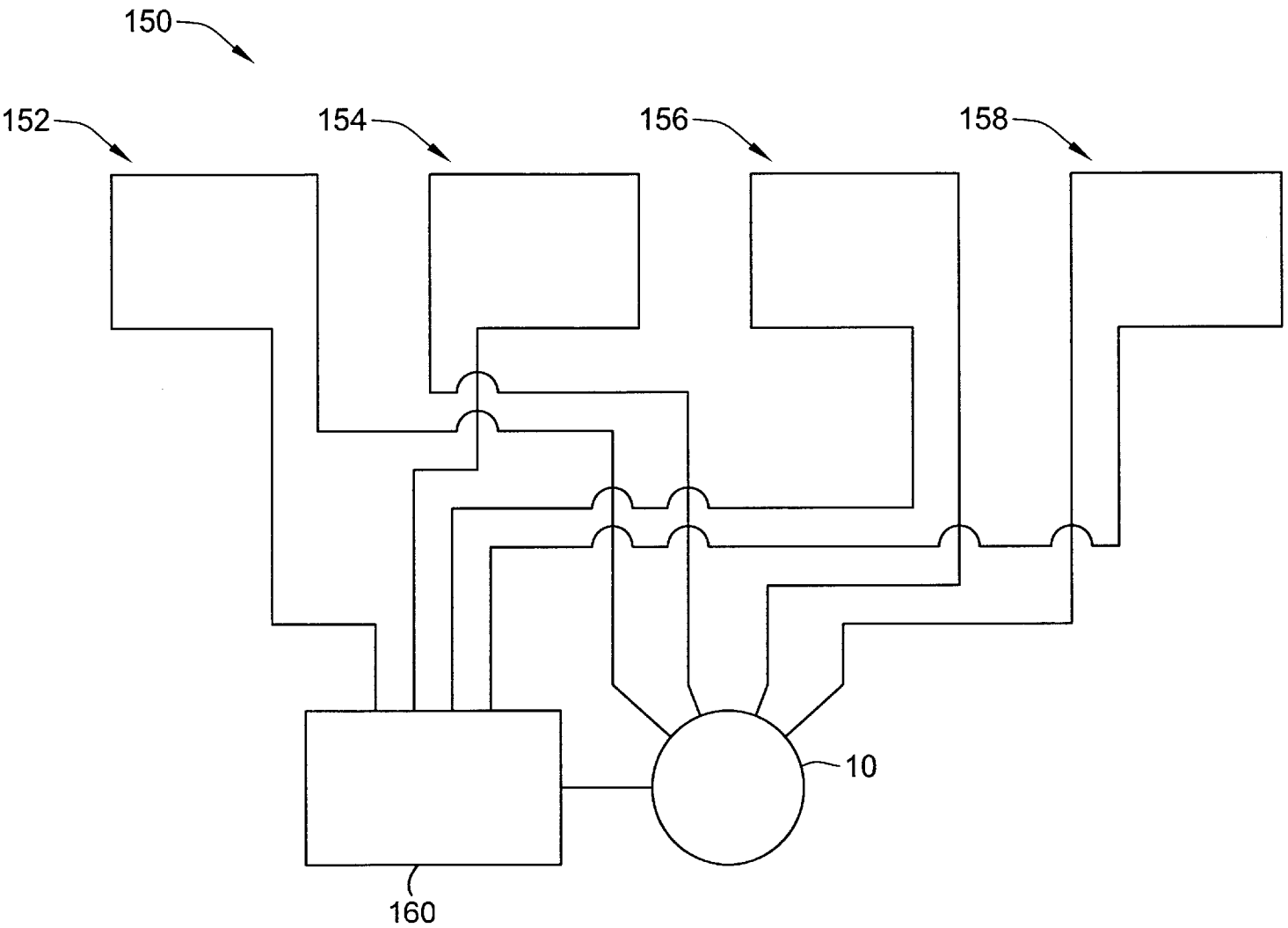
FIG. 6 is a schematic illustration of a heating system utilizing the pump assembly shown in FIG. 1 in accordance with an exemplary embodiment.

FIG. 6 is a schematic illustration of a heating system 150 utilizing the pump assembly 10 in accordance with an exemplary embodiment. The pump may be used in other types of systems in other embodiments, and the heating system 150 is merely illustrative of one exemplary embodiment. The heating system 150 includes multiple zones or circuits 152, 154, 156, 158. The pump assembly 10 supplies fluid flow through the various zones 152-158. Control valves are provided to control the flow of fluid through the particular zones 152-158. When a particular valve is open, the pump assembly 10 moves fluid through the particular zone 152-158. The pump assembly 10 may receive fluid from a supply 160, which may be a reservoir, a manifold, a supply pipe, a heat exchanger, and the like.

The operation of the pump assembly 10 depends on demand within the zones 152-158. When demand in any of the zones 152-158 is required, the pump assembly 10 may be operated and/or may be operated differently. For example, when the pump assembly 10 is operating to supply fluid to only one zone, such as the first zone 152, and then demand is required in another zone, such as the second zone, the pump assembly 10 may increase output such as by increasing speed. Alternatively, the pump assembly 16 may provide the same output but the amount of fluid supplied to the first zone 152 may decrease when the pump assembly 10 starts supplying fluid to the second zone 154.

In operation, it may be useful for the operator of the heating system 150 to be aware of one or more flow characteristics of the fluid supplied by the pump assembly 10. For example, the operator may want to change the operation mode of the pump assembly 10 if the flow rate is in a particular range or above or below a particular rate. Additionally, it may be useful for the operator to observe the flow rate of the pump assembly 10 during a configuration of the heating system 150. For example, when setting up the heating system 150, the operator may want to observe the flow rate as the operator cycles through the different zones to determine how the pump assembly 10 operates, particularly the throughput of the pump in terms of flow rate, when different combinations of the zones 152-158 are opened and closed. It may be useful for the operator to, observe the flow rate of the pump assembly 10 during a diagnostic test of the heating system 150 or the pump assembly 10. There are many other reasons that a user may want to know the flow rate of the fluid moved through the pump assembly 10. Additionally, by using a pump that determines the flow rate by measuring operating characteristics of the pump assembly 10 rather than by monitoring the actual flow rate of the fluid, such as with a separate flow sensor, a compact and robust system is provided with less components, less complexity, less set up time, and potentially less cost. By using a permanent magnet motor, an accurate rotational speed of the rotor may be known by monitoring an electrical characteristic of the stator, such as the frequency of the voltage of the stator. A direct correlation between such measured electrical characteristic and the rotational speed of the rotor is provided because the rotor of the permanent magnet motor has very little slip, as compared to non-permanent magnet motor type pumps. The user may also want to know other flow characteristics other than the flow rate, such as the pressure of the fluid. As such, the pressure may be displayed on the display of the user interface.

Figure 7:
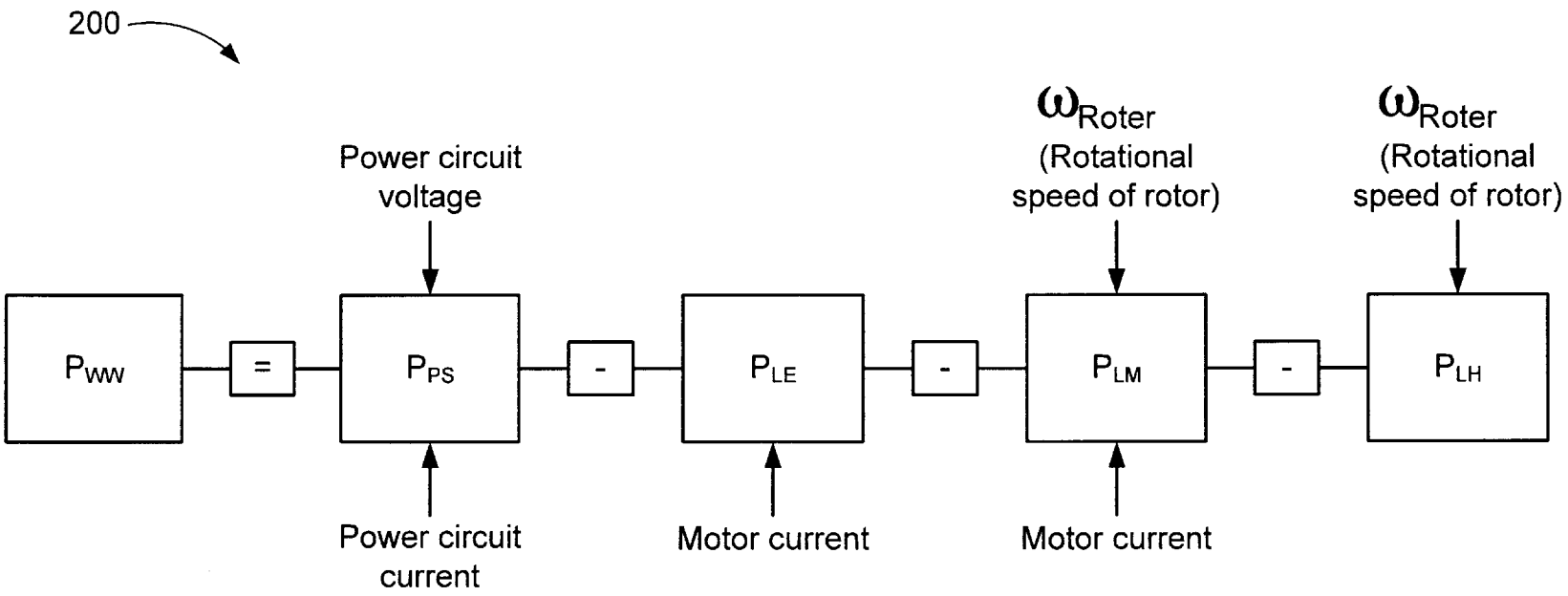
FIG. 7 is a power balance equation used by the pump assembly to determine flow characteristics shown in FIG. 1 in accordance with an exemplary embodiment.

FIG. 7 is a power balance equation 200 used by the pump assembly to determine flow characteristics. In the equation 200, PWW relates to the power resulting in water work; PPS relates to the power supply consumed; PLE relates to the power loss due to the electronics; PLM relates to the power loss due to the motor; and PLM relates to the power loss due to hydraulics. The power PPS may be determined by measuring the Voltage of the power supply, such as by directly or indirectly measuring the voltage of the power circuit, and by measuring the current in the power circuit. The power PLE may be determined by measuring the current in the motor. The power PLM may be determined by measuring the current in the motor and by measuring or calculating the rotational speed of the rotor. The power PLH may be determined by measuring or calculating the rotational speed of the rotor. In an exemplary embodiment, the rotational speed of the rotor may be determined based on the frequency of the stator field.

Different flow characteristics may be determined based on the power balance equation 200. For example, the power resulting in water work $P_{WW}$ may be used to determine flow characteristics such as flow rate (Q) and pressure (H). For example, $P_{WW}$ may be expressed according to the following equation:

$$P_{WW}=PQ+PH \quad (1)$$

Where PQ is the power used for generating flow (Q) and PH is the power used for generating pressure (H). PQ may expressed according to the following equation:

$$PQ=AQ^2+BQ+C=0 \quad (2)$$

Where A is a known constant times the rotational speed of the rotor (ω), B is a different known constant times the rotational speed of the rotor (ω) and C is equal to $P_{LH}$. The known constants may be based on the type of pump assembly used, and may be based on the particular impeller and/or volute of the pump assembly.

Once the power used to generate flow is known, the pressure may be found according to the following equation:

$$dp=aQ^2+bQ\omega+c\omega^2 \quad (3)$$

Where dp is the differential pressure, a is a known constant, Q is the flow rate, b is a different known constant, c is another known constant, and ω is the rotational speed of the rotor.

As described above, the controller 66 measures the electrical characteristics of the motor, and based on the measured characteristics, determines flow characteristics such as water work, flow rate and pressure. The controller 66 is connected to the user interface 68 such that the flow characteristics may be displayed thereon.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A pump assembly for a hydronic heating system, the pump assembly comprising:

a permanent magnet motor having a stator with coil windings;

a rotor assembly having a shaft and an impeller attached to the shaft, the shaft being driven by the stator, the impeller driving fluid through the pump assembly;

a pump housing holding the permanent magnet motor and the rotor assembly the pump housing having a suction end configured to be coupled to a supply pipe of the hydronic heating system and the pump housing having a discharge end configured to be coupled to a discharge pipe of the hydronic heating system, the impeller moves the fluid of the hydronic heating system to pump fluid through the hydronic heating system; and a control module mounted to the pump housing, the control module having a controller and a user interface, the controller measuring operating characteristics of at least one of the motor and the stator, the controller determining at least one of the flow rate and the pressure of the fluid moved through the pump assembly based on the operating characteristics measured of at least one of the motor and the stator, and the controller controlling power supply to the coil windings based on the operating characteristics measured of at least one of the motor and the stator, and the user interface being accessible at an exterior of the pump housing, the user interface being configured to display an output representative of at least one of the flow rate and the pressure of the fluid determined by the controller based on the measured operating characteristics of at least one of the motor and the stator.

2. The pump assembly of claim 1, wherein the controller is coupled to the stator for supplying power to the coil windings, the controller configured to measure the amount of power used to drive the permanent magnet motor, the controller configured to determine at least one of the flow rate and the pressure of the fluid moved through the pump assembly based on a power balance formula.

3. The pump assembly of claim 1, wherein the controller is coupled to the stator for supplying power to the coil windings, the controller configured to measure at least one of a current and a voltage of the permanent magnet motor, the controller configured to determine at least one of the flow rate and the pressure of the fluid moved through the pump assembly based on the current or the frequency measured.

4. The pump assembly of claim 1, wherein the controller is configured to measure characteristics relating to a power consumed by the stator and a speed of the rotor to determine at least one of the flow rate and the pressure of the fluid moved through the pump assembly.

5. The pump assembly of claim 1, wherein the control module determines the flow rate and the pressure without the use of a flow sensor.

6. The pump assembly of claim 1, wherein the control module is housed within a pump housing.

7. The pump assembly of claim 1, wherein the user interface is provided on an outer surface of the pump assembly.

8. The pump assembly of claim 1, wherein the coil windings are electrically connected to the controller and the user interface is electrically connected to the controller.

9. The pump assembly of claim 1, wherein the controller is configured to determine a power consumption of the pump assembly based on the characteristics measured and the user interface is configured to display an output representative of the power consumption.

10. The pump assembly of claim 1, further comprising a hydronic heating system comprising a supply pipe and a discharge pipe, the pump housing being coupled to the supply pipe, the pump housing being coupled to the discharge pipe.

11. A control module for a permanent magnet motor pump, the control module comprising:

a controller configured to be housed by a pump housing of the permanent magnet motor pump and configured to be coupled to a stator of the permanent magnet motor pump, the controller being configured to be coupled to a power source, the controller supplying power to coil windings of the stator and the controller measuring operating characteristics of the stator, wherein the controller determines a flow characteristic of the fluid moved by the permanent magnet motor pump based on the measured operating characteristics of the stator, the controller controlling power supply to the coil windings based on the measured operating characteristics; and a user interface integrated with the controller, the user interface displaying, at an exterior of the pump housing such that the user interface is visible when looking at the pump housing, an output representative of the flow characteristic of the fluid determined by the controller based on the measured operating characteristics of at least one of the motor and the stator.

12. The control module of claim 11, wherein the controller is configured to measure a current supplied to the coil windings and the controller is configured to measure a voltage of a power supply to the pump, the controller is configured to determine the flow characteristic based on the current measured and the voltage measured.

13. The control module of claim 11, wherein the controller measures characteristics relating to a power consumed by the stator and a speed of a rotor driven by the stator to determine the flow characteristic including a flow rate and a pressure.

14. The control module of claim 11, wherein the controller includes a circuit board, the user interface being mechanically and electrically connected to the circuit board.

15. A method of operating a pump having a permanent magnet motor with a stator and coil windings, the method comprising:

measuring at least one operating characteristic of at least one of the motor and the stator of the pump utilizing a controller integrated with the pump;

determining a flow characteristic of the fluid moved through the pump using the controller based on the at least one measured operating characteristic of at least one of the motor and the stator;

controlling power supply to the coil windings by the controller based on the measure operating characteristics of at least one of the motor and the stator; and displaying the determined flow characteristic based on the measured operating characteristics of at least one of the motor and the stator on a user interface integrated with the pump.

16. The method of claim 15, wherein the step of measuring at least one operating characteristic of the pump includes measuring a current supplied to the pump and measuring a speed of a rotor of the pump.

17. The method of claim 15, wherein the pump comprises a permanent magnet motor pump having a stator, the step of measuring at least one operating characteristic of the pump includes measuring at least one operating characteristic of the stator of the permanent magnet motor pump.

18. The method of claim 15, wherein the pump comprises a permanent magnet motor pump having a stator with coil windings, the step of measuring at least one operating characteristic of the pump includes measuring a voltage frequency of the coil windings.

19. The method of claim 15, wherein the step of determining is performed without the use of a flow sensor measuring the flow rate of the throughput of the pump and without the use of a pressure sensor measuring the flow pressure of the throughput of the pump.

20. The method of claim 15, further comprising providing the controller within a housing of the pump, wherein the user interface is mechanically and electrically coupled to the controller.

21. The method of claim 15, further comprising coupling a power source to the controller, wherein the step of measuring at least one operating characteristic of the pump includes measuring a power supply provided to the pump, and wherein the step of determining includes determining the flow rate of the pump based on a power balance equation.

22. The method of claim 15, further comprising adjusting an operation of the pump based on the determined flow characteristic.

23. The method of claim 15, wherein said displaying the determined flow characteristic comprises displaying a flow rate of the fluid.

24. The method of claim 15, wherein said displaying the determined flow characteristic comprises displaying a power consumption of the pump assembly.

25. The method of claim 15, wherein said displaying the determined characteristic comprises displaying the determined characteristic on a display provided on an outer surface of the pump assembly such that the display is visible when looking at the pump assembly.

26. A hydronic heating system comprising:

at least one pipe routed in a zone to be heated; and a pump assembly coupled to the at least one pipe, the pump assembly comprising:

a permanent magnet motor having a stator with coil windings;

a rotor assembly having a shaft and an impeller attached to the shaft, the shaft being driven by the stator, the impeller driving fluid through the pump assembly;

a pump housing holding the permanent magnet motor and the rotor assembly, the pump housing being coupled in fluid communication with the at least one pipe to pump fluid through the at least one pipe; and a control module mounted to the pump housing, the control module having a controller and a user interface being accessible at an exterior of the pump housing, the controller measuring operating characteristics of at least one of the motor and the stator, the controller determining at least one of the flow rate and the pressure of the fluid moved through the pump assembly based on the operating characteristics measured of at least one of the motor and the stator, the controller controlling power supply to the coil windings based on the operating characteristics measured of at least one of the motor and the stator, and the user interface being configured to display an output representative of at least one of the flow rate and the pressure of the fluid determined by the controller based on the measured operating characteristics of at least one of the motor and the stator.

27. The hydronic heating system of claim 26, wherein the hydronic heating system include multiple circuits each having at least one pipe, the pump assembly being fluidly coupled to the at least one pipe of each of the circuits for pumping fluid through each of the circuits.

28. The hydronic heating system of claim 26, further comprising valves for controlling fluid flow in corresponding circuits.

29. The hydronic heating system of claim 26, wherein the user interface is provided on an outer surface of the pump assembly such that the output is visible when looking at the pump assembly.

* * * * *